US010297381B2

(12) United States Patent
Horie et al.

(10) Patent No.: US 10,297,381 B2
(45) Date of Patent: May 21, 2019

(54) COMMON MODE CHOKE COIL

(71) Applicant: TAIYO YUDEN CO., LTD., Taito-ku, Tokyo (JP)

(72) Inventors: Katsuyuki Horie, Takasaki (JP); Hidemi Iwao, Takasaki (JP); Kenichiro Nogi, Takasaki (JP)

(73) Assignee: TAYO YUDEN CO., LTD., Tokyo (JP)

( * ) Notice: Subject to any disclaimer, the term of this patent is extended or adjusted under 35 U.S.C. 154(b) by 157 days.

(21) Appl. No.: 15/173,421

(22) Filed: Jun. 3, 2016

(65) Prior Publication Data

US 2016/0365191 A1 Dec. 15, 2016

(30) Foreign Application Priority Data

Jun. 9, 2015 (JP) ..... 2015-116720

(51) Int. Cl.
*H01F 27/29* (2006.01)
*H01F 27/24* (2006.01)
*H01F 27/28* (2006.01)

(52) U.S. Cl.
CPC ..... *H01F 27/2823* (2013.01); *H01F 27/24* (2013.01); *H01F 27/29* (2013.01); *H01F 27/292* (2013.01); *H01F 2027/2838* (2013.01)

(58) Field of Classification Search
CPC ..... H01F 27/2823; H01F 27/29; H01F 27/24; H01F 27/292; H01F 2027/2838; H01F 17/045
(Continued)

(56) References Cited

U.S. PATENT DOCUMENTS 6,157,283 A * 12/2000 Tsunemi ..... H01F 27/292 336/192
6,348,850 B1 * 2/2002 Kimura ..... H01F 17/045 336/200
(Continued)

FOREIGN PATENT DOCUMENTS

JP 2002110428 A 4/2002
JP 2005056934 A 3/2005
(Continued)

OTHER PUBLICATIONS

European Search Report (ESR) dated Nov. 4, 2016, issued for European counterpart patent application No. EP16173440.
(Continued)

*Primary Examiner* — Mang Tin Bik Lian
(74) *Attorney, Agent, or Firm* — Law Office of Katsuhiro Arai

(57) ABSTRACT

In an embodiment, a common mode choke coil 10 includes a drum core 12, coil part 30, and terminal electrodes 40, 42, 44, 46. The drum core 12 has a shaft part 14 and flange parts 16, 22, and conductive wires 32, 34 are wound around the outer periphery face of the shaft part 14 in the same winding direction by the same number of windings, with leader parts 32A, 32B, 34A, 34B led from both ends thereof. The flange parts 16, 22 have side face grooves 18, 20, 24, 26 on their side faces 16C, 16D, 22C, 22D, inside which side face grooves the engagement parts 40A, 42A, 44A, 46A are provided and positioned across the center of the flange part 16 or 22 in the height direction, where the leader parts 32A, 32B, 34A, 34B are electrically connected to the terminal electrodes 40, 42, 44, 46.

4 Claims, 7 Drawing Sheets

(58) Field of Classification Search
USPC ..... 336/83, 192, 212
See application file for complete search history.

(56) References Cited

U.S. PATENT DOCUMENTS

| | | | | |
|---|---|---|---|---|
| 2001/0038327 | A1 | 11/2001 | Aoki et al. | |
| 2008/0003864 | A1* | 1/2008 | Hatakeyama | H01F 17/045 439/399 |
| 2009/0045902 | A1 | 2/2009 | Hirai | |
| 2009/0219127 | A1* | 9/2009 | Tomonari | H01F 19/04 336/192 |

FOREIGN PATENT DOCUMENTS

| | | | |
|---|---|---|---|
| JP | 2007329169 | A | 12/2007 |
| JP | 2012029210 | A | 2/2012 |
| WO | 2008096487 | A1 | 8/2008 |

OTHER PUBLICATIONS

A Notification of Reasons for Refusal issued by the Japanese Patent Office, dated Mar. 6, 2018, for Japanese counterpart application No. 2015-116720.

* cited by examiner

COMMON MODE CHOKE COIL

BACKGROUND

Field of the Invention

The present invention relates to a common mode choke coil, and more specifically to improvement of variation of properties, size reduction, and thickness reduction in a coil-type common mode choke coil.

Description of the Related Art

Electronic devices are using increasingly higher frequencies and the accuracy required of their components is also increasing in recent years. Common mode choke coils are primarily classified into the coil type and film type, and in high-frequency applications, coil-type common mode choke coils are often used for their good properties in these applications. However, coil-type common mode choke coils are subject to variation of properties due to the accuracy of winding coils, which makes it difficult to reduce the size, especially thickness, of these choke coils.

As for the coils of coil-type common mode choke coils, Patent Literature 1 below describes a wound coil and winding method, for example. The winding structure disclosed in Patent Literature 1 not only aims to allow for magnetic coupling of two wire materials that are wound simultaneously, but it also aims to prevent step down. Besides the above, common mode choke coils using two conductive wires are disclosed in Patent Literatures 2 and 3 below. In all of the arts described in these Patent Literatures 1 to 3, the leader parts of the windings are joined to terminal electrodes either at the bottom face of the flange on the board-mounted side or top face of the flange on the opposite side.

BACKGROUND ART LITERATURES

[Patent Literature 1] International Patent Laid-open No. WO2008/096487

[Patent Literature 2] Japanese Patent Laid-open No. 2005-56934

[Patent Literature 3] Japanese Patent Laid-open No. 2012-29210

SUMMARY

Under the prior arts mentioned above, however, it was not easy to achieve the same number of windings and same length for the two conductive wires because the structure having joining parts at the top face of the flange or bottom face of the flange causes the length of each leader part to become different. This gave rise to the problem of lost symmetry of impedance properties and consequent difficulty supporting higher frequencies. Particularly when the position at the start of winding the conductive wire is very different from the position at the end of winding the conductive wire, as shown in FIGS. 2 and 5 of Patent Literature 1 above, the leader part becomes longer at the end of winding than at the start of winding, and this length difference of leader part generates Rdc (direct-current resistance) variation to tip the balance between right and left. Also, all of the prior arts presented a problem in that thickness reduction was limited because the joining parts at the top face of the flange or bottom face of the flange would impose limitation in the height direction.

The present invention focuses on the aforementioned points and an object of the present invention is to provide a coil-type common mode choke coil that improves the symmetry of impedance properties and thereby support higher frequencies, while also allowing for thickness reduction and improved mountability.

Any discussion of problems and solutions involved in the related art has been included in this disclosure solely for the purposes of providing a context for the present invention, and should not be taken as an admission that any or all of the discussion were known at the time the invention was made.

The present invention is a common mode choke coil comprising: a drum core having a shaft part and flange parts positioned on both ends thereof; a coil part having a winding part constituted by conductive wires wound around the shaft part, as well as leader parts led from the winding part; and terminal electrodes having engagement parts that are electrically connected to the leader parts; wherein such common mode choke coil is characterized in that: the coil part has two conductive wires wound in the same winding direction by the same number of windings around the shaft part; the flange parts each have a bottom face on the board-mounted side as well as side faces intersecting with the bottom face, with each side face having a side face groove; and the engagement parts are each provided in the side face groove and, when viewed from the bottom face, positioned across the center of the flange part in the height direction.

One primary embodiment is characterized in that, in a section of the shaft part crossing at right angles to the axial direction at the center of the shaft part in the length direction, the maximum dimension of the shaft part in the width direction parallel with the bottom face is greater than the maximum dimension of the shaft part in the height direction vertical to the bottom face. Another embodiment is characterized in that it has a sheet core assembled onto the top face of the flange part and, in a section of the shaft part crossing at right angles to the axial direction at the center of the shaft part in the length direction, the cross-section area of the sheet core is greater than the cross-section area of the shaft part. The aforementioned and other objects, properties and benefits of the present invention are made clear from the detailed explanation below as well as from the drawings attached hereto.

According to the present invention, the coil part is constituted by two conductive wires wound around the shaft part by the same number of windings and the leader parts are connected to the engagement parts of the terminal electrodes in the side face grooves of the flange parts, and therefore the lengths of the leader parts can be made identical at the start of winding and end of winding of the conductive wires. This way, the two conductive wires have the same lengths at the winding part and leader part, which improves the symmetry of impedance properties and allows higher frequencies to be supported. Also because the engagement parts are provided on the side faces of the flange parts, any limitation in the height direction is eliminated to allow for thickness reduction and mountability improvement.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1(A) is a side view of the drum core, FIG. 1(B) is a side view of FIG. 1(A) above as seen from the direction of arrow F1*a*, FIG. 1(C) is a side view of FIG. 1(A) above as seen from the direction of arrow F1*b*, FIG. 1(D) is a section view of FIG. 1(A) above as cut along line #A-#A and seen from the direction of the arrow, and FIG. 1(E) is an end face view of FIG. 1(A) above as cut along line #B-#B. FIG. l(F) is a section view of a comparative example corresponding to FIG. 1(D) above.

FIG. 2(A) is an exterior perspective view, and FIG. 2(B) is a side view showing an embodiment of coil.

FIG. 3(A) is a side view of FIG. 2(A) above as seen from the arrow F2*a* side, FIG. 3(B) is a side view of FIG. 2(A) above as seen from the arrow F2*b* side, and FIG. 3(C) is a development view of a terminal bracket installed on the flange part.

FIG. 4(A) is a development view of one terminal bracket, FIG. 4(B) is a side view showing the terminal bracket in FIG. 4(A) above as bent at the specified position, and FIG. 4(C) is a side view of FIG. 4(B) above as seen from the direction of arrow F4.

FIG. 6(A) is a plan view showing the position at which the conductive wire is secured by the engagement part and securing part, FIG. 6(B) is a drawing showing the engagement part before and after bending, and FIG. 6(C) is a drawing showing the state after welding and securing.

DESCRIPTION OF THE SYMBOLS

Figure 1A:
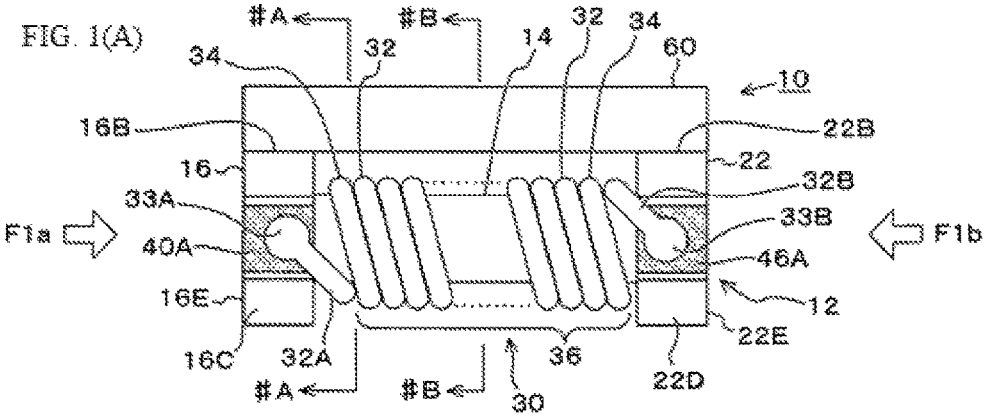
FIG. 1(A) to 1(E) are drawings illustrating Example 1 of the present invention, where

10: Common mode choke coil
12: Drum core
14: Shaft part
16, 22: Flange part
16A, 22A: Bottom face
16B, 22B: Top face
16C, 16D, 22C, 22D: Side face
16E, 16F, 22E, 22F: End face
16G, 16H, 22G, 22H: Chamfered part
16I, 22I: Top face groove
18, 20, 24, 26: Side face groove
30: Coil part
32, 24: Conductive wire
32A, 32B, 34A, 34B: Leader part
33A, 33B, 35A, 35B: Connection part
36: Winding part
40, 42, 44, 46: Terminal electrode
40A, 42A, 44A, 46A: Engagement part
40B, 42B, 44B, 46B: End face part
40C, 42C, 44C, 46C: Mounting part
50: Shaft part
52: Conductive wire
56: Leader part
58: Flange part
58A: Bottom face
60: Sheet core
62A, 62B, 62C, 62D: Depression
100: Common mode choke coil
110, 110', 110A, 110B, 130, 130': Terminal bracket
111, 131: End face part
112, 132: Belt-shaped part
112A, 132A: Top face contact part
112B, 115, 132B: Fitting part
113, 133: Expansion part
113A, 113B, 133A, 133B: Side part
114, 134: Mounting part
116, 136: Joining part
118, 138: Engagement part
118A, 138A: Receiving part
118B, 138B: Restraining part
118C, 138C: Tip part
120, 140: Securing part
120A, 140A: Bending part
120B, 140B: Wide part
120C, 140C: Connection part
122: Projection
150: End face bonding position
152: Side face bonding position
154: Top face bonding position

DETAILED DESCRIPTION OF EMBODIMENTS

The best mode for carrying out the present invention is explained in detail below based on examples.

EXAMPLE 1

Figure 1B:
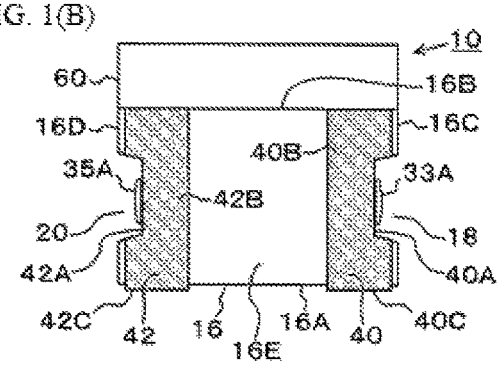
Figure 1C:
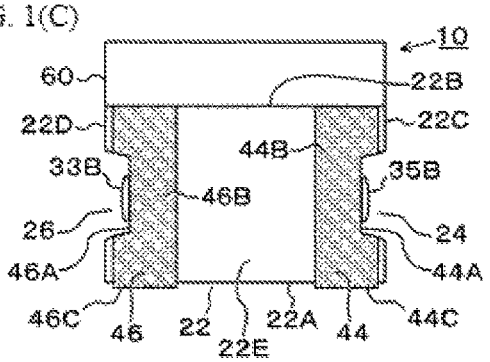
Figure 1D:
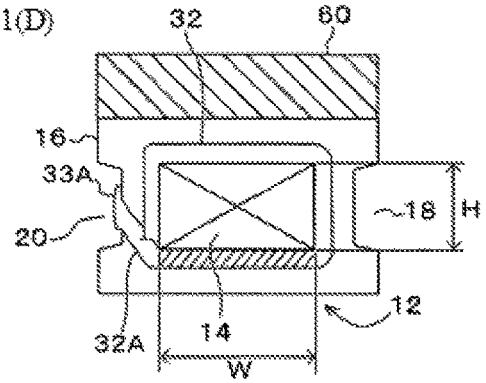
Figure 1F:
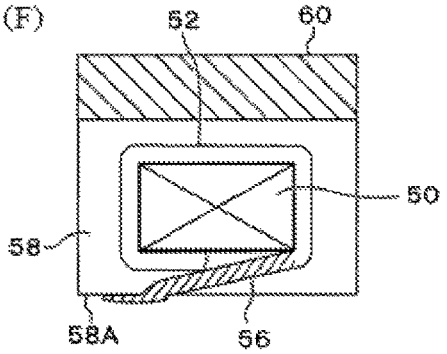
Figure 1E:
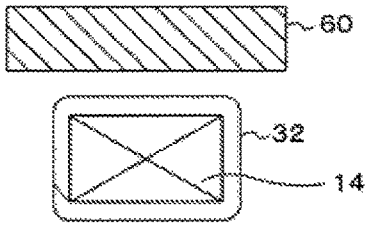

First, Example 1 of the present invention is explained by referring to FIG. 1(A), FIG. 1(B), FIG. 1(C), FIG. 1(D), and FIG. 1(E). FIG. 1(A) is a side view of the common mode choke coil in this example, FIG. 1(B) and FIG. 1(C) are side views of FIG. 1(A) above as seen from the directions of arrow F1*a* and arrow F1*b*, respectively, FIG. 1(D) is a section view of FIG. 1(A) above as cut along line #A-#A and seen from the direction of the arrow, FIG. 1(F) is a section view of a comparative example corresponding to FIG. 1(D) above, and FIG. 1(E) is an end face view of FIG. 1(A) above as cut along line #B-#B. A common mode choke coil 10 in this example comprises a drum core 12, coil part 30, terminal electrodes 40, 42, 44, 46, and sheet core 60, as shown in FIGS. 1(A) to 1(C).

The drum core 12 comprises a shaft part 14 whose section shape is roughly rectangular, as well as flange parts 16, 22 of roughly rectangular shape provided on both ends thereof. The coil part 30 has a winding part 36 constituted by two conductive wires 32, 34 wound around the outer periphery of the shaft part 14 in the same winding direction by the same number of windings, as well as leader parts 32A, 32B, 34A, 34B led from both ends of the respective conductive wires 32, 34. The winding part 36 refers to the conductive wires 32, 34 contacting the shaft part 14, and at the winding part formed by the two conductive wires, the same number of windings is achieved by making the lengths of the conductive wires 32, 34 identical. Also, the leader part refers to the section of each conductive wire from the end of its winding part to its securing part. The terminal electrodes 40, 42 are provided on the flange part 16, while the other terminal electrodes 44, 46 are provided on the other flange part 22, and have engagement parts 40A, 42A, 44A, 46A electrically connected to the leader parts 32A, 32B, 34A, 34B, respectively.

One flange part 16, as shown in FIG. 1(B), has grooves running through in the thickness direction of the flange part on its side faces 16C, 16D intersecting with the face on the board-mounted side (bottom face 16A), which are referred to as side face grooves 18, 20. On the side faces 16C, 16D, these side face grooves 18, 20 are formed at a position crossing the center of the flange part 16 in the height direction, as viewed from the bottom face 16A of the flange part. It should be noted that, in the example illustrated, the side face grooves 18, 20 are connected to the bottom part, via tapered surfaces, from the side faces 16C, 16D, respectively, and formed on the inner side of the surfaces of the side faces 16C, 16D. The tapered surfaces are provided on both sides in a manner sandwiching the bottom part, and each tapered surface need to be angled only as necessary according to the leader direction, etc. The thickness of the flange part gives the maximum dimension when viewed in the length direction of the shaft part at a position 0.1 mm higher than the top face of the shaft part.

One terminal electrode 40 provided on the flange part 16 has an engagement part 40A formed at the bottom of the side face groove 18 (refer to FIG. 1(A)), end face part 40B formed on the side face 16C side of the end face 16E of the flange part, and mounting part 40C formed on the bottom face 16A side of the flange part 16. The other terminal electrode 42 provided on the flange part 16 also has the same configuration, having an engagement part 42A formed at the bottom of the side face groove 20, end face part 42B formed on the side face 16D side of the end face 16E of the flange part, and mounting part 42C formed on the bottom face 16A side of the flange part 16.

The other flange part 22 also has basically the same configuration as the flange part 16 in that, as shown in FIG. 1(C), it has grooves running through in the thickness direction of the flange part on the side faces 22C, 22D intersecting with the face on the board-mounted side (bottom face 22A), which are referred to as side face grooves 24, 26, respectively. On the side faces 22C, 22D, these side face grooves 24, 26 are formed at a position crossing the center of the flange part 22 in the height direction, as viewed from the bottom face 22A of the flange part. It should be noted that, in the example illustrated, the side face grooves 24, 26 are connected to the bottom part, via tapered surfaces, from the side faces 22C, 22D, respectively, and formed on the inner side of the surfaces of the side faces 22C, 22D. The tapered surfaces are provided on both sides in a manner sandwiching the bottom part, and each tapered surface need to be angled only as necessary according to the leader direction, etc. Alternatively, the other flange part 22 can have a symmetrical shape with respect to the one flange part 16.

One terminal electrode 44 provided on the flange part 22 has an engagement part 44A formed at the bottom of the side face groove 24, end face part 44B formed on the side face 22C side of the end face 22E of the flange part, and mounting part 44C formed on the bottom face 22A side of the flange part 22. The other terminal electrode 46 provided on the flange part 22 also has the same configuration, having an engagement part 46A formed at the bottom of the side face groove 26 (refer to FIG. 1(A)), end face part 46B formed on the side face 22D side of the end face 22E of the flange part, and mounting part 46C formed on the bottom face 22A side of the flange part 22.

The leader parts 32A, 32B, 34A, 34B on both ends of the two conductive wires 32, 34 of the coil part 30 are electrically connected to the engagement parts 40A, 42A, 44A, 46A of the terminal electrodes formed in the side face grooves 18, 20, 24, 26, respectively. In this example, the ends of the leader parts 32A, 32B, 34A, 34B are connected by means of thermal compression, etc., and therefore connection parts 33A, 33B, 35A, 35B are formed. This way, the engagement parts 40A, 42A, 44A, 46A at the bottom of the side face grooves 18, 20, 24, 26 formed at positions crossing the centers of the side faces 16C, 16D, 22C, 22D of the flange parts 16, 22, are connected to the leader parts 32A, 32B, 34A, 34B. This means that, on the side faces of the flange parts 16, 22, the leader parts 32A, 32B, 34A, 34B are connected to the terminal electrodes 40, 42, 44, 46 via the connection parts 33A, 33B, 35A, 35B at the center positions of the flange parts 16, 22 in the height direction (including parts other than exact centers so long as they are inside the range where the engagement parts 40A, 42A, 44A, 46A are formed). Additionally under the present invention, the coil part 30 is constituted by the two conductive wires 32, 34 wound around the shaft part 14 in the same direction by the same number of windings, and therefore the lengths of the two conductive wires 32, 34 can be made identical and the symmetry of impedance properties improve as a result. Further, the center positions of the side face grooves 18, 20, 24, 26 in the height direction are matched with the center positions of the flange parts 16, 22 in the height direction. This way, the top and bottom dimensions of the side faces of the flange parts 16, 22, except for the side face grooves 18, 20, 24, 26, can be made identical so that mechanical strength can be achieved in these areas. Also, the center position of the shaft part 14 in the height direction is matched with the center positions of the flange parts 16, 22 in the height direction. This way, the risks of the winding part 36 getting damaged during the course of handling, etc., after winding can be suppressed. Also, the heights of both the side face grooves 18, 20, 24, 26 and the shaft part 14 can be aligned to the centers of the flange parts 16, 22 in the height direction, or the flange parts 16, 22 can be made symmetrical, to provide a drum core which is symmetrical in the vertical direction (height direction) or lateral direction (width direction). Such symmetrical drum core makes it easy to regulate the direction of the drum core in the next step or eliminates the need to regulate the direction, thereby reducing problems relating to regulation of direction.

Also, in this example, the shaft part 14 has a uniform dimension in the length direction, and as shown in FIG. 1(D), its maximum dimension in the width direction W is greater than its maximum dimension in the length direction H in a section crossing at right angles with the axial direction of the shaft part 14. This means that, as shown in FIG. 1(D), the relative length of the leader part 32A in the conductive wire 32 can be reduced and the length of the conductive wire 32 contacting the shaft part 14 (length of the conductive wire 32 contributing to the properties) can be increased, to obtain better properties. On the other hand, the comparative example as shown in FIG. 1(F) is such that the end of a conductive wire 52 wound around a shaft part 50 is led from a bottom face 58A of a flange part 58, and since a leader part 56 not contacting the shaft part 50 becomes long in this configuration, clearly the properties are inferior to those under the present invention. It should be noted that, although the section views in FIG. 1(D) and FIG. 1(F) show positions closer to the end of the shaft part 14, the same effects can still be obtained even when the winding ends of the conductive wires 32, 34 are near the approximate center of the shaft part 14, for example. Also, the conductive wires may overlap each other when wound if the number of windings is high, in which case the winding part may be deemed to include the conductive wires in a range where the distance from the shaft part 14 corresponds to the thickness of one conductive wire, by assuming that the conductive wires in this range contribute to the properties even if they do not directly contact the shaft part 14.

Furthermore, in this example, as shown in FIG. 1(E), the cross-section area of the sheet core 60 is set greater than the cross-section area of the shaft part 14, in a section crossing at right angles with the axial direction at the center of the shaft part 14 in the length direction. Under the present invention, the leader parts are connected to the side faces of the flange parts 16, 22, which allows thickness of the sheet core 60 to be ensured compared to when they are connected to the top faces 16B, 22B, which in turn allows the sheet core 60 to have greater cross-section area as mentioned above. This eliminates leakage of magnetic flux and also makes it possible to limit the magnetic flux by the shaft part 14, and therefore any variation in properties caused by assembling the sheet core 60 can be suppressed. In addition, a mechanically strong, small, and highly reliable component can be obtained. Also, the section shape of the shaft part need not be rectangular, and it can be hexagonal or oval. Particularly when thin conductive wires are used, tension fluctuation of the conductive wires can be suppressed and the two conductive wires can be wound precisely alongside each other.

One example of dimensions of the common mode choke coil 10 in this example is a product size of 2.0×1.2×1.0 mm. Also, for the drum core 12 and sheet core 60, Ni—Zn ferrite material was used, for example. The material had a magnetic permeability (μ) of 500, but any material with a magnetic permeability of 400 to 1000 is acceptable. Also, the outer dimensions of the drum core 12 are 1.95 mm in length, 1.2 mm in width, and 0.7 mm in height. Its shaft part 14 is 0.8 mm wide and 0.3 mm high, its flange parts 16, 22 are 0.2 mm thick, and its side face grooves 18, 20, 24, 26 are 0.35 mm wide and 0.2 mm deep. The side face grooves 18, 20, 24, 26 are formed in a manner running through in the thickness direction of the flange parts 16, 22, have a bottom part at the center of the groove, and have a width corresponding to the dimension of the bottom. Also, the sheet core 60 has outer dimensions of 2.0 mm in length, 1.2 mm in width, and 0.25 mm in height, and used the same Ni—Zn ferrite used for the drum core 12.

Additionally, for the conductive wires 32, 34 forming the coil part 30, UEW (polyurethane copper wire) of 0.1 mm in diameter was used. Also for the terminal electrodes 40, 42, 44, 46, Ag paste was baked and Ni/Sn-plating was applied to achieve a total thickness of 0.1 mm. In addition, epoxy (Tg 125° C. specification) was used as the adhesive with which to assemble the sheet core 60 to the top faces 16B, 22B of the flange parts 16, 22.

Next, an example of the manufacturing procedure of the common mode choke coil 10 in this example is explained. Binder is mixed into Ni—Zn ferrite material and the mixture is compression-molded using molding dies to obtain a molded product of drum shape. The molded product is deburred, as necessary, because it often has molding burrs, etc. The molded product may be agitated together with abrasive media, or it may be sand-blasted. Thereafter, the deburred molded product is sintered at the necessary sintering temperature to obtain a magnetic body for drum core 12 having a shaft part 14 and flange parts 16, 22. A sheet core 60 is also manufactured in a similar manner by sintering a die-molded sheet. Next, Ag paste is transferred onto the specified positions of the flange parts 16, 22 using rollers, followed by heat treatment and Ni/Sn-plating, to form terminal electrodes 40, 42, 44, 46. Then, first a primary-side conductive wire 32 is wound around the shaft part 14 by the necessary number of times, and second a secondary-side conductive wire 34 is wound in the same winding direction by the same number of times along the primary-side conductive wire 32. It should be noted that, before the conductive wires 32, 34 are wound, their winding-starting sides (such as leader parts 32A, 34A) are thermally compressed to the engagement parts 40A, 42A of the terminal electrodes 40, 42 on the side faces 16C, 16D of the flange parts. The winding-ending sides (such as leader parts 32B, 34B) are thermally compressed to the engagement parts 46A, 44A of the terminal electrodes 46, 44 on the side faces 22C, 22D of the flange parts. Thereafter, adhesive (not illustrated) is applied to the top faces 16B, 22B of the flange parts of the drum core 12 using a dispenser, and then the sheet core 60 is thermally cured and secured at a position overlapping the drum core 12. A common mode choke coil 10 thus obtained is mounted in an electronic component, etc., by means of soldering the mounting parts 40C, 42C, 44C, 46C of the terminal electrodes 40, 42, 44, 46.

As described above, Example 1 achieves the following effects:

(1) The engagement parts 40A, 42A, 44A, 46A of the terminal electrodes 40, 42, 44, 46 are provided in the side face grooves 18, 20, 24, 26 formed at positions crossing the centers, in the height direction, of the side faces 16C, 16D, 22C, 22D of the flange parts 16, 22, and these engagement parts are connected to the leader parts 32A, 32B, 34A, 34B of the conductive wires 32, 34. Also, the conductive wires 32, 34 are wound in the same direction by the same number of windings. As a result, the lengths of the two conductive wires 32, 34 can be made identical, which improves the symmetry of impedance properties and allows higher frequencies to be supported.

Also, the lengths of the leader parts 32A, 32B, 34A, 34B can be shortened and therefore the winding part contacting the magnetic body (shaft part 14) (part contributing to the properties) can be made longer, which in turn leads to better filter properties. Furthermore, any limitation in the height direction can be eliminated by not providing the engagement parts on the top faces 16B, 22B of the flange parts or bottom faces 16A, 22A of the flange parts, but by providing the engagement parts 40A, 42A, 44A, 46A on the side faces 16C, 16D, 22C, 22D of the flange parts. Then, the foregoing also makes it possible to achieve minimum difference in properties between the two conductive wires 32, 34 as well as good filter properties, support higher frequencies, and keep the height dimension low.

(2) In the section crossing at right angles with the axial direction at the center of the shaft part 14 in the length direction, the maximum dimension in the width direction W is set greater than the maximum dimension in the height direction H. As a result, the relative length of the leader part can be reduced more when the height dimension is lower so as to increase lengths of the conductive wires 32, 34 contacting the shaft part 14 and achieve better properties.

(3) There is a sheet core 60 assembled to the top faces 16B, 22B of the flange parts, where the cross-section area of the sheet core 60 is set greater than the cross-section area of the shaft part 14 in the section crossing at right angles with the axial direction at the center of the shaft part 14 in the length direction. Since the leader parts 32A, 32B, 34A, 34B are connected to the side faces 16C, 16D, 22C, 22D of the flange parts, thickness of the sheet core 60 can be increased like this, and also by setting the cross-section area of the sheet core 60 greater, leakage of magnetic flux can be suppressed. In addition, the cross-section area of the shaft part 14 can be reduced to limit the magnetic flux running through the shaft part 14, so variation in properties caused by assembling the sheet core 60 can be reduced. Also, a mechanically strong, small, and highly reliable common mode choke coil 10 can be obtained.

(4) Furthermore in this example, there are no conductive wires 32, 34 at the mounting parts 40C, 42C, 44C, 46C of the terminal electrodes 40, 42, 44, 46 on the mounting surface side, which eliminates the need to ensure terminal electrode thickness required for connection and consequently the terminal electrodes can be made thinner.

(5) Also, soldering the mounting parts 40C, 42C, 44C, 46C of the terminal electrodes 40, 42, 44, 46 at the time of mounting achieves good solder wettability even when the areas of the mounting parts 40C, 42C, 44C, 46C are small, which ensures mountability and mounting strength and consequently allows for size reduction.

(6) Furthermore, there are no conductive wires 32, 34 on the mounting surface side, so height-direction variations of the mounting parts 40C, 42C, 44C, 46C of the respective terminal electrodes can be reduced, which in turn permits reliable mounting.

EXAMPLE 2

Figure 2A:
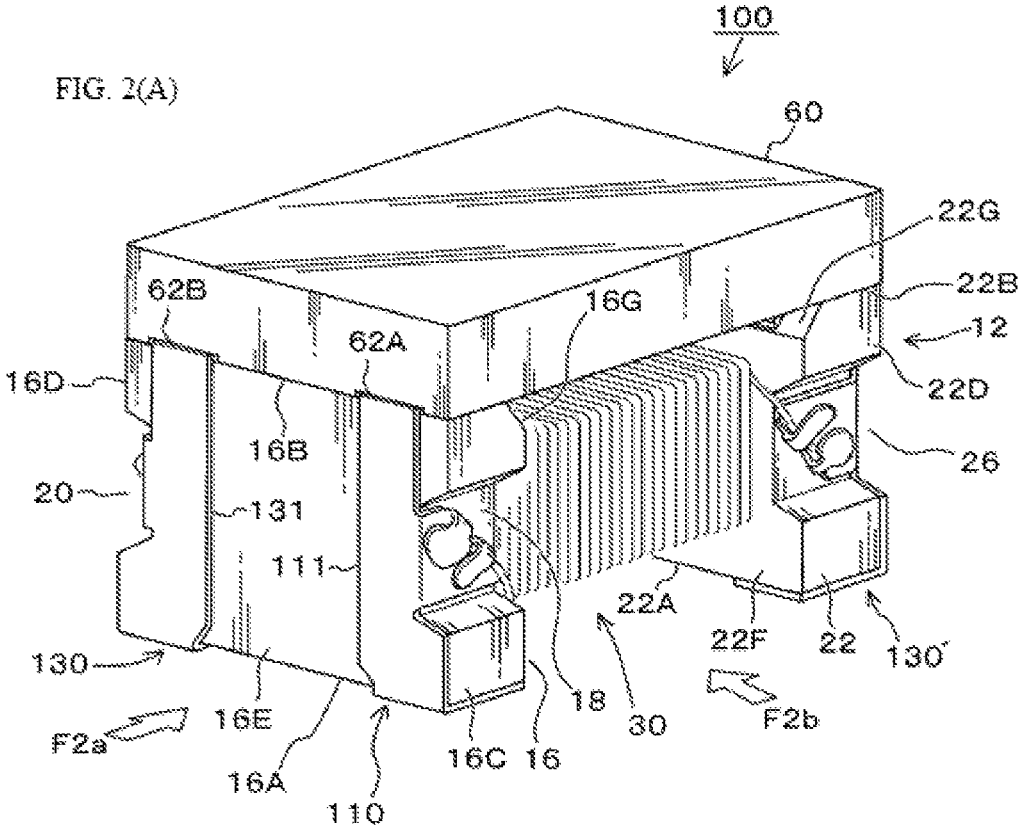
FIG. 2(A) and FIG. 2(B) are drawings illustrating the common mode choke coil in Example 2 of the present invention, where
Figure 2B:
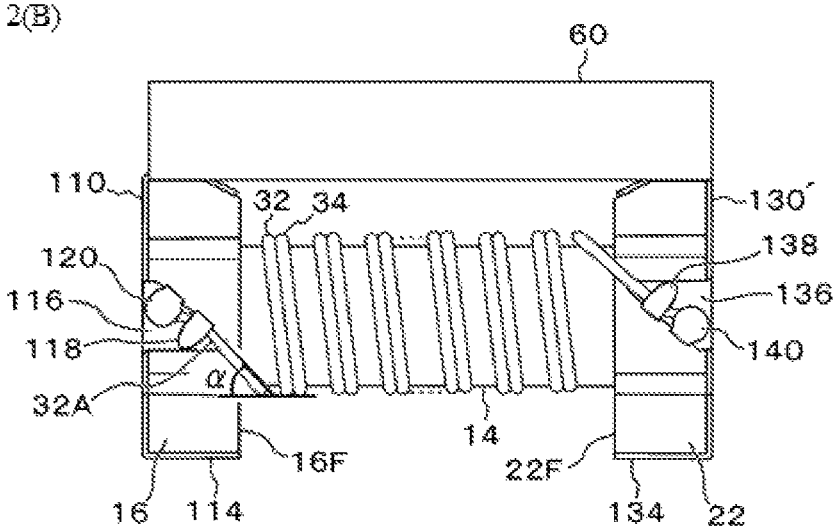

Next, Example 2 of the present invention is explained by referring to FIGS. 2(A) and 2(B) to FIG. 7(A), FIG. 7(B), and FIG. 7(C). Those component elements that are identical or corresponding to their counterparts in Example 1 as described above use the same symbols. FIG. 2(A) and FIG. 2(B) illustrate the common mode choke coil in this example, where FIG. 2(A) is an exterior perspective view and FIG. 2(B) is a side view showing an embodiment of a coil. FIG. 3(A) is a side view of FIG. 2(A) and FIG. 2(B) above as seen from the direction of arrow F2*a*, FIG. 3(B) is a side view of FIG. 2(A) and FIG. 2(B) above as seen from the direction of arrow F2*b*, and FIG. 3(C) is a development view of a terminal bracket. As shown in FIGS. 2(A) and 2(B) and 3(A), 3(B), and 3(C), a common mode choke coil 100 in Example 2 comprises a drum core 12, coil part 30, terminal brackets 110, 110', 130, 130', and sheet core 60. The configuration of the drum core 12 is basically the same as that in Example 1 as described above, but in Example 2, chamfered parts 16G, 22G are provided from the top faces 16B, 22B of the flange parts toward the end faces 16F, 22F on the inner side. This is to secure the terminal brackets 110, 110', 130, 130' mentioned below and prevent them from coming off. The configuration of the coil part 30 is the same as that in Example 1 mentioned above. Also, depressions 62A, 62B, 62C, 62D that can accommodate the thickness of the terminal brackets 110, 110', 130, 130' are provided in the sheet core 60 (refer to FIG. 5(D)). Instead of forming four depressions individually, depressions may be formed by two grooves in a manner connecting the depressions by the grooves in the axial direction.

This example is different from Example 1 described above in that the terminal electrodes are constituted by the terminal brackets 110, 110', 130, 130' using phosphor bronze sheets or copper sheets, instead of applying electrode material on the flange parts 16, 22 to form the terminal electrodes. The terminal bracket 110 is installed on the side face 16C side, while the terminal bracket 130 is installed on the side face 16D side, of one flange part 16. Also, the terminal bracket 110' is installed on the side face 22C side, while the terminal bracket 130' is installed on the side face 22D side, of the other flange part 22. The terminal bracket 110 is explained by also referring to FIG. 4(A), FIG. 4(B), and FIG. 4(C). FIG. 4(A) is a plan view of the terminal bracket 110 shown in FIG. 3(C), before bending, as viewed from the reverse side, FIG. 4(B) is a plan view of the terminal bracket 110 as bent at the specified position, and FIG. 4(C) is a side view of FIG. 4(B) above as seen from the direction of arrow F4.

As shown in these figures, the terminal bracket 110 has an end face part 111 constituted continuously by a belt-shaped part 112 of flat belt shape and a wide expansion part 113. The expansion part 113, whose inclined side parts 113A, 113B are connected to the long sides of the belt-shaped part 112, is offset from the belt-shaped part 112. Also, a joining part 116 shaped as a right triangle or as a right triangle with at least one sharp corner cut off, is provided below the belt-shaped part 112. Two tabs are provided on the upward-facing oblique side of the joining part 116. The bottom tab is an engagement part 118 for tentatively securing the conductive wires 32, 34, while the top tab is a securing part 120 for securing the conductive wires 32, 34 by means of welding.

Figure 3A:
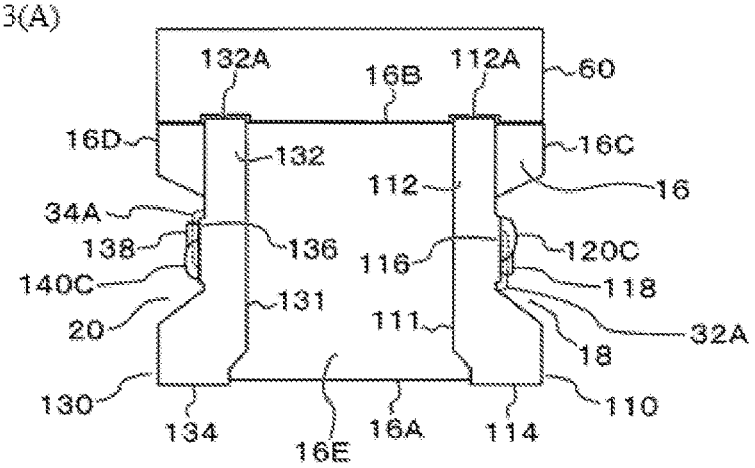
FIG. 3(A), FIG. 3(B), and FIG. 3(C) are drawings illustrating Example 2 above, where
Figure 3B:
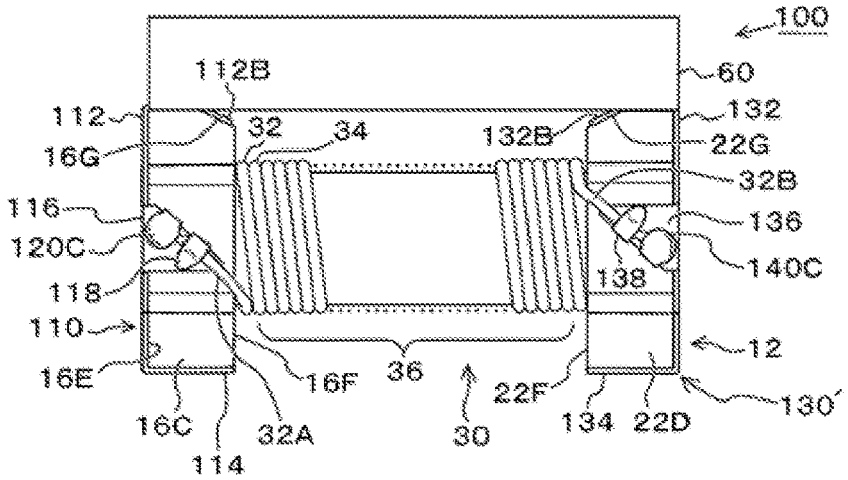
Figure 3C:
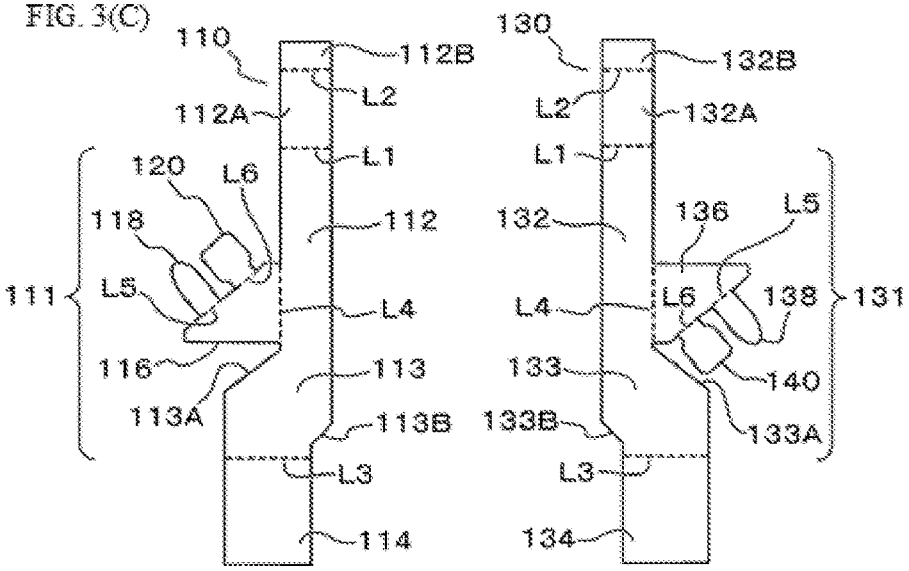
Figure 4A:
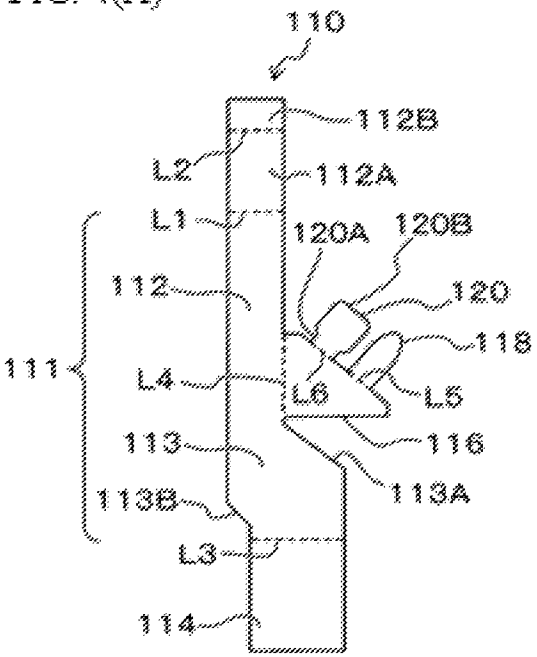
FIG. 4(A), FIG. 4(B), and FIG. 4(C) are drawings illustrating the terminal bracket in Example 2 above, where
Figure 4B:
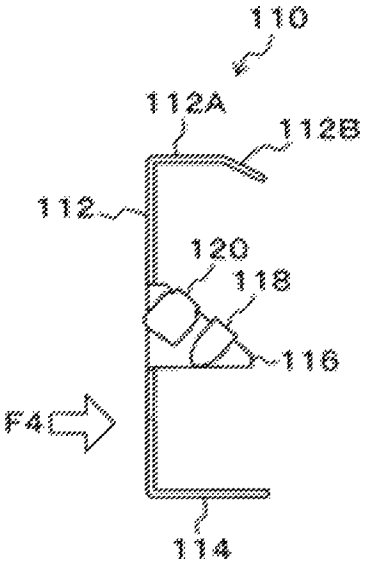
Figure 4C:
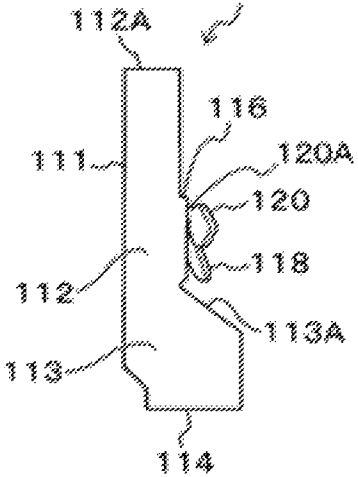

By bending the top of the belt-shaped part 112 along the broken lines L1, L2 shown in FIG. 3(C), a top face contact part 112A and fitting part 112B are formed, as shown in FIG. 4(B). Also, by bending the expansion part 113 along the broken line L3 shown in FIG. 3(C), a mounting part 114 is formed, as shown in FIG. 4(B). Furthermore, by bending the belt-shaped part 112 along the broken line L4 shown in FIG. 3(C), a joining part 116 shown in FIG. 4(B) is obtained. Then, by bending the joining part 116 along the broken lines L5, L6 shown in FIG. 3(C), an engagement part 118 and securing part 120 are formed, as shown in FIGS. 4(B) and 4(C) (it should be noted that FIG. 4(C) shows a state where the part is not fully bent). The dimensions of the terminal bracket 110, as bent as shown in FIG. 4(B), are set in such a way that, when it is installed on the side face 16C side of the flange part 16, the end face part 111 contacts the end face 16E of the flange part, the top face contact part 112A contacts the top face 16B of the flange part, the fitting part 112B engages with the chamfer 16G of the flange part 16, the mounting part 114 contacts the bottom face 16A of the flange part, and the joining part 116 contacts the bottom of the side face groove 18 of the flange part 16, as shown in FIG. 2(A). The terminal bracket 110' also has a similar configuration and is installed on the side face 22C side of the flange part 22.

As shown in FIG. 3(C), the other terminal bracket 130 has an end face part 131 constituted continuously by a belt-shaped part 132 of flat belt shape and a wide expansion part 133, where the expansion part 133, whose inclined side parts 133A, 133B are connected to the long sides of the belt-shaped part 132, is offset from the belt-shaped part 132. It should be noted that the direction of this offset is opposite to that of the terminal bracket 110. Also, a joining part 136 roughly of triangle is provided below the belt-shaped part 132. Two tabs are provided on the downward-facing oblique side of the joining part 136. The top tab provided on the oblique side is an engagement part 138 for tentatively securing the conductive wires 32, 34, while the bottom tab is a securing part 140 for securing the conductive wires 32, 34 by means of welding. In other words, the terminal bracket 130 has a shape asymmetrical to the terminal bracket 110. It should be noted that the broken lines L1 to L6 indicating the positions at which to bend the terminal bracket 130 are the same as those of the terminal bracket 110. And, the terminal bracket 130 that has been bent into the specified shape is installed on the side face 16D side of the flange part 16, as shown in FIG. 2(A). Its dimensions are set in such a way that, when it is installed, the end face part 131 contacts the end face 16E of the flange part, a top face contact part 132A contacts the top face 16B of the flange part, a fitting part 132B engages with the chamfer 16G of the flange part 16, a mounting part 134 contacts the bottom face 16A of the flange part, and the joining part 136 contacts the bottom of the side face groove 20 of the flange part 16, as shown in FIG. 2(A). The terminal bracket 130' also has the same configuration as the terminal bracket 130, and is installed on the side face 22D side of the flange part 22.

One example of dimensions of the common mode choke coil 100 in this example is a product size of 4.5 mm in length×3.2 mm in width×2.8 mm in height. Also, for the drum core 12 and sheet core 60, Ni—Zn ferrite material was used, for example. The material had a magnetic permeability (μ) of 500, but any material with a magnetic permeability of 400 to 1000 is acceptable. Also, the outer dimensions of the drum core 12 are 4.3 mm in length, 3.2 mm in width and 2.1 mm in height. Its shaft part 14 is 1.6 mm wide and 0.8 mm high, its flange parts 16, 22 are 0.6 mm thick, and its side face grooves 18, 20, 24, 26 are 0.7 mm wide and 0.5 mm deep. The side face grooves are formed in a manner running through in the thickness direction of the flange part, have a bottom part at the center of the groove, and have a width corresponding to the dimension of the bottom. Also, the chamfers 16G, 22G of the flange parts 16, 22 are C0.3 (indicating the size of chamfer, where the chamfered part in the direction parallel with the shaft is 0.3 mm long).

The sheet core 60 has outer dimensions of 4.5 mm in length, 3.2 mm in width and 0.6 mm in height, while the bonding depressions 62A, 62B, 62C, 62D are 0.6 mm long, 0.5 mm wide, and 0.2 mm deep. Also, for the conductive wires 32, 34 forming the coil part 30, AIW (polyamide imide copper wire) of 0.05 mm in diameter was used. Additionally, for the terminal brackets 110, 110', 130, 130', Ni/Sn-plated phosphor bronze sheet of 0.1 mm in thickness was used. Furthermore, epoxy (Tg 160° C. specification) was used for the adhesive with which to bond the terminal brackets 110, 110', 130, 130'.

Next, an example of the manufacturing procedure of the common mode choke coil 100 in this example is explained by referring to FIGS. 5(A), 5(B), 5(C), and 5(D). FIGS. 5(A), 5(B), 5(C), and 5(D) are drawings illustrating the procedure to install the terminal brackets 110, 110', 130, 130' and sheet core 60. It should be noted that the method for forming the drum core 12 is the same as that of Example 1 mentioned above, except that chamfers 16G, 22G are provided on the top faces 16B, 22B of the flange parts toward the end faces 16F, 22F on the inner side. Additionally, as for the terminal brackets 110, 110', 130, 130', the flat phosphor bronze sheets are bent beforehand at the specified positions.

Figure 5A:
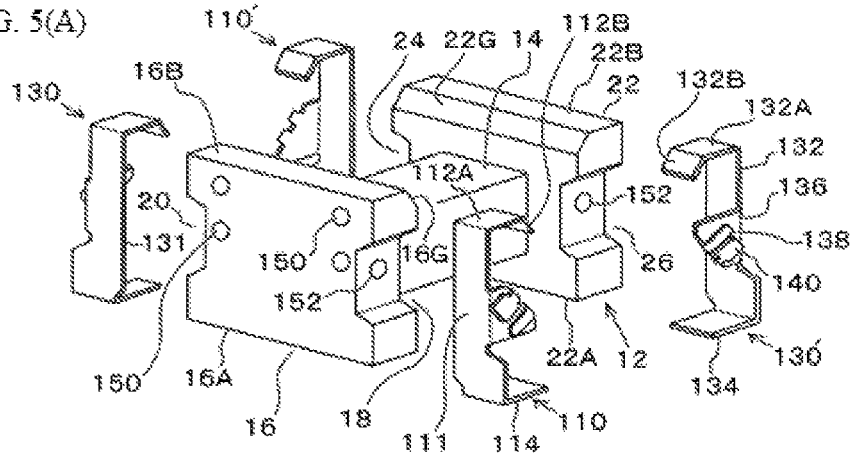
FIG. 5(A), FIG. 5(B), FIG. 5(C), and FIG. 5(D) are drawings illustrating an example of manufacturing processes for the common mode choke coil in Example 2 above.
Figure 5B:
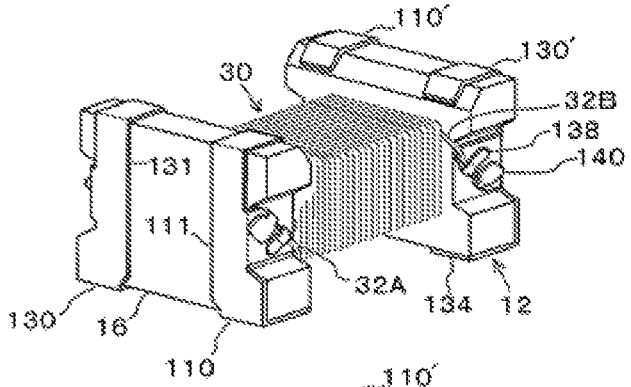

First, as shown in FIG. 5(A), the terminal brackets 110, 110' are installed on the side face 16C side of the flange part 16 and side face 22C side of the flange part 22, and at the same time the terminal brackets 130, 130' are installed on the side face 16D side of the flange part 16 and side face 22D side of the flange part 22. Also, at the specified positions of the end faces 16E, 22E on the outer side of the flange parts 16, 22, adhesive is applied beforehand at an end face bonding position 150 or side face bonding position 152 or both, in order to bond and accurately position the assembled terminal brackets 110, 110', 130, 130'. The end face bonding position 150 is arranged above the center of the flange part 16 or 22 in the height direction. Then, as shown in FIG. 5(B), the primary-side conductive wire 32 and secondary-side conductive wire 34 are wound in the same direction by the specified number of windings according to a procedure similar to that of Example 1. It should be noted that the leader parts 32A, 32B, 34A, 34B of the conductive wires 32, 34 are stripped of their sheath using a short-pulse laser and tentatively secured with the engagement parts 118, 138 of the joining parts 116, 136 beforehand. It should be noted that the coil of the coil part 30 may look like that shown in FIG. 2(A), but space may be provided between the coils as shown in FIG. 2(B). Here, it is convenient from the viewpoints described later for angle α, formed by each of the leader parts 32A, 32B, 34A, 34B, and the axial direction of the shaft part 14, to be in a range of 30 to 60 degrees.

Figure 6A:
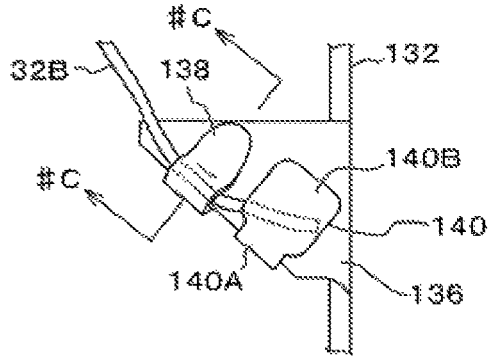
FIG. 6(A), FIG. 6(B), and FIG. 6(C) are drawings illustrating the joining part of the terminal bracket in Example 2 above, where
Figure 6B:
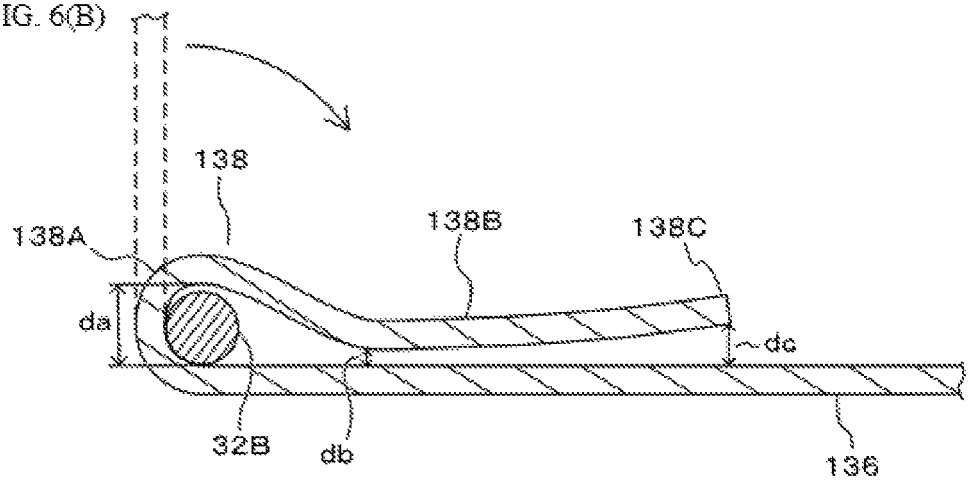
Figure 6C:
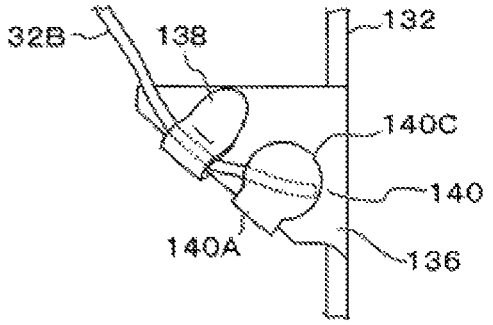

FIG. 6(A), FIG. 6(B), and FIG. 6(C) are drawings illustrating the joining part 136 on the terminal bracket 130 side, where FIG. 6(A) is a plan view showing the position at which the leader part 32B is secured by the engagement part 138 and securing part 140, FIG. 6(B) is a drawing showing the engagement part 138 before and after bending, in the form of a section view of FIG. 6(A) above cut along line #C-#C, and FIG. 6(C) is a drawing showing the state after welding and securing. As shown in FIG. 6(B), the engagement part 138 comprises a receiving part 138A, restraining part 138B and tip part 138C, in this order, from the bending side. As for the distance from the joining part 136, the distance da between the receiving part 138A and joining part 136 is the greatest, even greater than the diameter of the conductive wire 32. This is to achieve positioning without damaging the conductive wire 32. Also, the distance db between the restraining part 138B and joining part 136 is the smallest, even smaller than the diameter of the conductive wire 32. This is to prevent the conductive wire 32 that has been guided through the receiving part 138A, from shifting. The distance dc between the tip part 138C and joining part 136 is set smaller than da but greater than db. Such engagement part 138 is bent along a plane crossing at right angles with the axial direction of the conductive wire 32. This way of bending allows the conductive wire 32 to be tentatively secured as a straight line, without bending, in the receiving part 138A. The joining part 116 on the terminal bracket 110 side has a similar configuration, where the engagement part 118 has a receiving part 118A, restraining part 118B and tip part 118C.

Figure 5C:
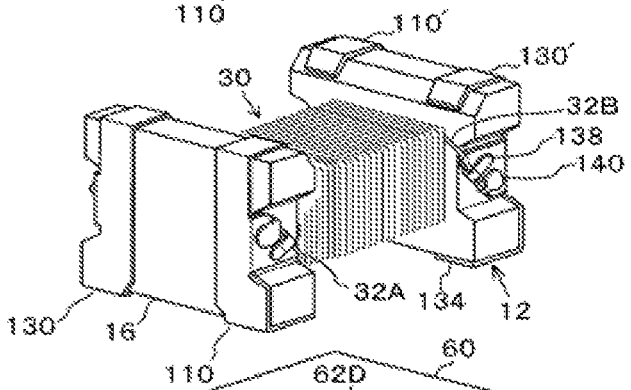
Figure 5D:
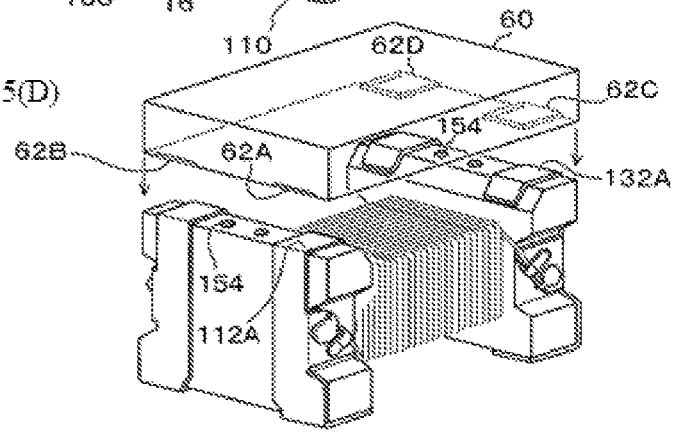

Next, as shown in FIG. 5(C), the tentatively secured leader parts 32A, 32B, 34A, 34B are secured by means of welding. To be specific, wide parts 120B, 140B of the securing parts 120, 140 are melted using a YAG laser. Then, as shown in FIG. 6(C), the melted area rises and the width contracts slightly, and consequently a generally round connection part 140C is formed and the leader part 32B of the conductive wire 32 is secured. The other leader parts 32A, 34A, 34B are secured in a similar manner. Thereafter, as shown in FIG. 5(D), adhesive is applied to a top face bonding position 154 on the top faces 16B, 22B of the flange parts, after which the depressions 62A, 62B, 62C, 62D are aligned with the positions of the top face contact parts 112A, 132A of the terminal brackets 110, 130 and the sheet core 60 is bonded. The common mode choke coil 100 thus obtained is mounted in an electronic component, etc., by means of soldering the mounting parts 114, 134 of the terminal brackets 110, 110', 130, 130'.

Figure 7A:
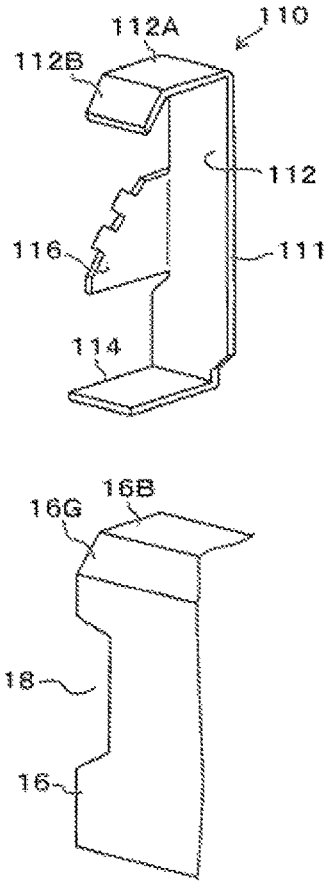
FIG. 7(A), FIG. 7(B), and FIG. 7(C) are drawings illustrating an anti-detachment structure for the terminal bracket in Example 2 above.
Figure 7B:
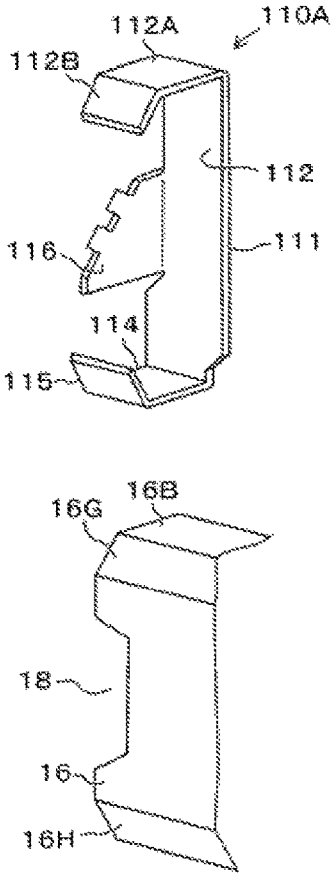
Figure 7C:
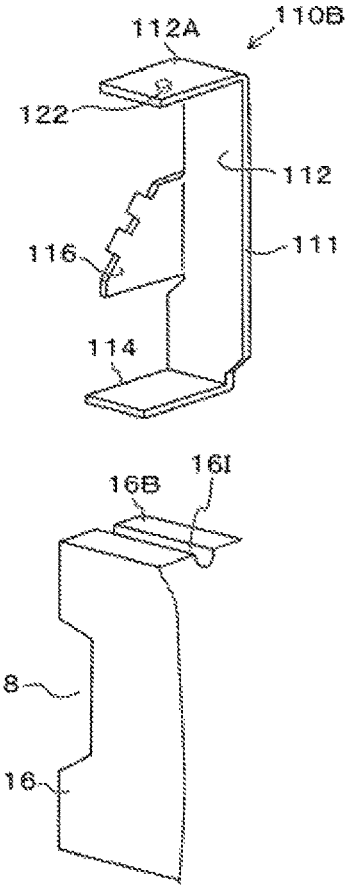

<Variation Examples>—FIG. 7(A), FIG. 7(B), and FIG. 7(C) show variation examples of the anti-detachment, positioning, and other structures using terminal brackets. As in the examples shown in FIGS. 2(A) to 6(C), in FIG. 7(A), the tip of the top face contact part 112A of the terminal bracket 110 is bent to provide a fitting part 112B that engages with a chamfered part 16G provided on the top face 16B side of the flange part. A terminal bracket 110A in FIG. 7(B) forms a fitting part 115 when the bottom side of the end face part 112, or specifically the tip of the mounting part 114, is bent, and it is caused to engage with a chamfered part 16H provided on the bottom face 16A side of the flange part. In other words, the terminal bracket 110A is such that the fitting parts 112B, 115 are caused to engage with the chamfered parts 16G, 16H provided on top and bottom of the flange part. A terminal bracket 110B shown in FIG. 7(C) gives an example where a projection 122 is provided on the inner side of the top face contact part 112A, and a top face groove 16I with which the projection 122 engages is provided on the top face 16B of the flange part. Not only on the top face side of the flange part, but also a projection may be provided on the mounting part 114 and a groove provided on the bottom face 16A of the flange part, in a similar manner. It is also possible, for example, to provide a chamfered part 16H on the bottom face 16A side of the flange part, provide a top face groove 161 for positioning on the top face 16B side of the flange part, provide a projection 122 on the top face contact part 112A of the terminal bracket, and then bend the tip of the mounting part 114 to form a fitting part 115. In other words, the example shown in FIG. 7(B) and example shown in FIG. 7(C) may be combined.

The basic operations and effects of this example are similar to those of Example 1 above. In Example 2, the following effects are obtained further in addition to the aforementioned operations and effects:

(1) The terminal brackets 110, 110', 130, 130' that form the terminal electrodes are present on parts of the top faces 16B, 22B, side face grooves 18, 20, 24, 26 of the side faces 16C, 16D, 22C, 22D, bottom faces 16A, 22A, and end faces 16E, 22E, of the flange parts 16, 22 of the drum core 12, and therefore can be placed accurately on the drum core 12.

(2) When the leader parts 32A, 32B, 34A, 34B led from the winding part 36 are such that they have the angle $\alpha$ of 30 to 60 degrees relative to the axial direction of the shaft part 14 as viewed from the side face and that their angle at the start of winding is the same as that at the end of winding, then the leader parts 32A, 32B, 34A, 34B can be positioned in a stable manner without causing the coil to become loose, as is shown in FIG. 2(B). Also, joining can be made securely, unaffected by the thickness of the conductive wires 32, 34. Furthermore, the resulting good accuracy of positioning allows for reduction in the area required for connection, which makes it possible to use the present invention for small components.

(3) The terminal brackets 110, 110', 130, 130' have engagement parts 118, 138 that are clinched to secure the leader parts 32A, 32B, 34A, 34B, and these engagement parts 118, 138 are bent along a plane crossing at right angles with the axial direction of the conductive wires 32, 34. As a result, the conductive wires 32, 34 can be enveloped without fail.

(4) The engagement part 138 is constituted by the receiving part 138A, restraining part 138B, and tip part 138C, in this order, from the bending side, and the distance from the joining part 136 to each part increases in the order of the distance to the restraining part 138B, to tip part 138C, and to the receiving part 138A, where the distance da to the receiving part 138A is greater than the thickness of the conductive wires 32, 34, while the distance db to the restraining part 138B is smaller than the thickness of the conductive wires 32, 34. This allows for positioning without damaging the conductive wires 32, 34.

(5) A chamfered part is provided on the top face of the flange part toward the end face on the inner side and an engagement part is provided at the tip of the top face contact part of the terminal bracket (example of FIG. 7(A)), or a chamfered part is also provided on the bottom face of the flange part toward the end face on the inner side and an engagement part is provided at the tip of the mounting part of the terminal bracket (example of FIG. 7(B)), or a top face groove 161 is formed on the top face of the flange part in a direction crossing at right angles with the axial direction and a projection 122 is provided on the inner side of the top face contact part of the terminal bracket (FIG. 7(C)). This way, the terminal bracket can be positioned and secured. The terminal bracket can also be prevented from detaching.

(6) The bonding position is selected as either the end face bonding position 150 or side face bonding position 152, or both, and if the end face bonding position 150 is used, it is arranged at a position higher than the center of the flange part 16 or 22 in the height direction so as to reduce any negative effect of solder flux when the bonding part is mounted. If the side face bonding position 152 is used, on the other hand, oozing-out of adhesive toward the outer side can be prevented and the terminal electrode becomes stronger against lateral stress.

It should be noted that the present invention is not limited to the aforementioned examples in any way, and various changes may be added to the extent that they do not deviate from the key points of the present invention. For example, the following are also included:

(1) The shapes and dimensions shown in the aforementioned examples are nothing more than examples and may be changed as deemed appropriate if necessary.

(2) The materials of each part shown in the aforementioned examples are nothing more than examples and any of various known materials may be used.

(3) The manufacturing procedures shown in the aforementioned examples are also nothing more than examples and may be changed as deemed appropriate to the extent that similar effects are achieved.

(4) The methods for winding the conductive wires 32, 34 shown in the aforementioned examples are nothing more than examples and may be changed as deemed appropriate if necessary.

(5) Preferable examples of use of the common mode choke coil proposed by the present invention involve high-frequency components, but applying it to other known applications in general is not prevented.

According to the present invention, a common mode choke coil is provided that comprises: a drum core having a shaft part and flange parts positioned on both ends thereof; a coil having a winding part constituted by conductive wires wound around the shaft part, as well as leader parts led from the winding part; and terminal electrodes having engagement parts that are electrically connected to the leader parts; wherein the coil has two conductive wires wound in the same winding direction by the same number of windings around the shaft part; the flange parts each have a groove on its side face crossing the mounting surface; and the engagement parts are each present inside the groove and positioned across the center of the flange part in the height direction. As a result, the lengths of the leader parts can be made identical at the start of winding and end of winding of the conductive wires by joining at the center of the side face of the flange part in the height direction, which improves the symmetry of impedance properties and allows higher frequencies to be supported. Also, by providing a joining part on the side face of the flange part, any limitation in the height direction can be eliminated to allow for thickness reduction. As a result, the present invention can be applied to high-frequency components and other applications.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2015-116720, filed Jun. 9, 2015, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A common mode choke coil, comprising:

a drum core having a shaft part and flange parts positioned on both ends thereof;

a coil part having a winding part constituted by conductive wires wound around the shaft part, as well as leader parts led from the winding part;

terminal electrodes having engagement parts that are electrically connected to the leader parts; and a sheet core assembled onto a top face of the flange part, wherein:

the coil part has two conductive wires wound in a same winding direction by a same number of windings around the shaft part;

the flange parts each have a bottom face on a board-mounted side as well as side faces intersecting with the bottom face, with each side face having a side face groove with tapered surfaces toward a bottom part of the side face groove, which tapered surfaces are provided on both sides of the bottom part continuously in a height direction, wherein a center position of each side face groove in the height direction is matched with a center position of the shaft core in the height direction;

each engagement part is provided in the side face groove and, when viewed from the bottom face, positioned across a center of the flange part in the height direction, wherein each leader part is connected to the corresponding engagement part at the bottom part of the side face groove via a bottom of the tapered surface of the side face groove; and in a section of the shaft part crossing at right angles with an axial direction at a center of the shaft part in a length direction, a cross-section area of the sheet core is greater than a cross-section area of the shaft part.

2. A common mode choke coil according to claim 1, wherein, in a section of the shaft part crossing at right angles with an axial direction at a center of the shaft part in a length direction, a maximum dimension of the shaft part in a width direction parallel with the bottom face is greater than a maximum dimension of the shaft part in the height direction vertical to the bottom face.

3. A common mode choke coil according to claim 1, wherein each terminal electrode is constituted by a terminal bracket wherein a tentative engagement part for tentatively securing the conductive wire and a welded securing part for securing the conductive wire by welding are provided.

4. A common mode choke coil according to claim 1, wherein an angle formed by each leader part and an axial direction of the shaft core as viewed from the side toward the side face grooves is 30 to 60 degrees.

* * * * *